US010943558B2

(12) United States Patent
Kumar L. S. et al.

(10) Patent No.: US 10,943,558 B2
(45) Date of Patent: Mar. 9, 2021

(54) EDP MIPI DSI COMBINATION ARCHITECTURE

(71) Applicant: Intel Corporation, Santa Clara, CA (US)

(72) Inventors: Aruna Kumar L. S., Bangalore (IN); Sunil Kumar C. R., Bangalore (IN); Sanjib Basu, Bangalore (IN); Prakash K. Radhakrishnan, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 1050 days.

(21) Appl. No.: 15/199,125

(22) Filed: Jun. 30, 2016

(65) Prior Publication Data

US 2018/0005597 A1 Jan. 4, 2018

(51) Int. Cl.
*G09G 5/00* (2006.01)
*G09G 5/36* (2006.01)

(52) U.S. Cl.
CPC ..... *G09G 5/006* (2013.01); *G09G 5/36* (2013.01); *G09G 2330/021* (2013.01); *G09G 2330/04* (2013.01); *G09G 2340/0407* (2013.01); *G09G 2360/02* (2013.01)

(58) Field of Classification Search
CPC ..... G09G 2330/021; G09G 2330/04; G09G 2340/0407; G09G 2360/02; G09G 5/006; G09G 5/36
See application file for complete search history.

(56) References Cited

U.S. PATENT DOCUMENTS

2004/0227747 A1* 11/2004 Ishibashi ..... G09G 5/006 345/204
2008/0254588 A1* 10/2008 Chuang ..... H01L 21/28185 438/308
2009/0243712 A1 10/2009 Chiang
2011/0133780 A1* 6/2011 Shau ..... H03K 19/018585 326/87
2012/0182273 A1* 7/2012 Ninomiya ..... G06F 3/1431 345/204
2013/0235039 A1 9/2013 Montag
2015/0186091 A1 7/2015 Kumar

OTHER PUBLICATIONS

"International Application Serial No. PCT/US2017/037709, International Search Report dated Sep. 14, 2017", 3 pgs.
"International Application Serial No. PCT/US2017/037709, Written Opinion dated Sep. 14, 2017", 10 pgs.
"International Application Serial No. PCT/US2017/037709, International Preliminary Report on Patentability dated Jan. 10, 2019", 12 pgs.

* cited by examiner

*Primary Examiner* — Ram A Mistry
(74) *Attorney, Agent, or Firm* — Schwegman Lundberg & Woessner, P.A.

(57) ABSTRACT

An integrated circuit is described. The integrated circuit includes a display controller having a driver. The display controller is configurable to select two or more display interfaces. The driver is designed to drive respective signals for the two or more display interfaces through a single output.

25 Claims, 11 Drawing Sheets

EDP MIPI DSI COMBINATION ARCHITECTURE

TECHNICAL FIELD

The field of invention relates generally to integrated circuit design, and more specifically to a display driver capable of driving multiple display interfaces.

BACKGROUND

There are presently a myriad of display interface standards available to integrated circuit designers who design display controllers. Display controllers are circuits that control and determine the specific information and signaling directed to a display such as a liquid crystal display (LCD) or Light Emitting Diode (LED) display. Display interfaces are the circuits that actually transport the information to the display via electrical signaling. Each display interface typically has its own set of electrical signaling requirements. Part of the reason for the existence of various display interfaces is the history of display technology. Specifically, some display interfaces have evolved from television while others have evolved from computing systems.

With the convergence of computing and television, it is often required to include many of these standards. Therefore display controller designers are faced with the challenge of trying to integrate a multitude of different interfaces on a single semiconductor die. The incorporation of a large number of different interfaces (e.g., Display Port (DP), embedded Display Port (eDP), High Definition Multimedia Interface (HDMI), high speed Mobile Industry Processor Interface (MIPI) Display Serial Interface (DSI), low power MIPI DSI, etc.) is inefficient in terms of the silicon die real estate that is consumed incorporating a unique and custom circuit for each different interface the display controller is to support.

Moreover, even if the consumption of silicon die surface area were not a problem, the number of I/Os (e.g., solder balls) that each unique interface would introduce to the overall I/O count of the die may very well be prohibitive.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Systems and methods for configuring multiple display interfaces in a single display controller using a driver are described herein. The systems and methods described herein may include a high speed pull-up/pull-down driver and a low power pull-up/pull-down driver.

The systems and methods described herein may include a combination embedded Display Port (eDP) Mobile Industry Processor Interface (MIPI) Display Serial Interface (DSI) driver, such as eDP MIPI DSI driver at 8.1 Gbps (e.g., conforming to an eDP standard, such as eDP1.5) and a MIPI driver at 4.5 Gbps (e.g., conforming to a MIPI standard, such as DPHY2.0). The combination driver allows for Original Equipment Manufacturers (OEMs) to flexibly choose either eDP or MIPI DSI panels. The combination driver may include an area or pin count optimization or reduction from separate drivers, such as, for 14 nm an approximately 42%/0.21 sqmm reduction and for 10 nm an approximately 27%/0.15 sqmm reduction. The combination driver may allow for a reduction in number of bumps/pins (10 Number), which may result in cost saving. The system on a chip (SOC) may be of a smaller form factor when using a combination driver.

Figure 1:
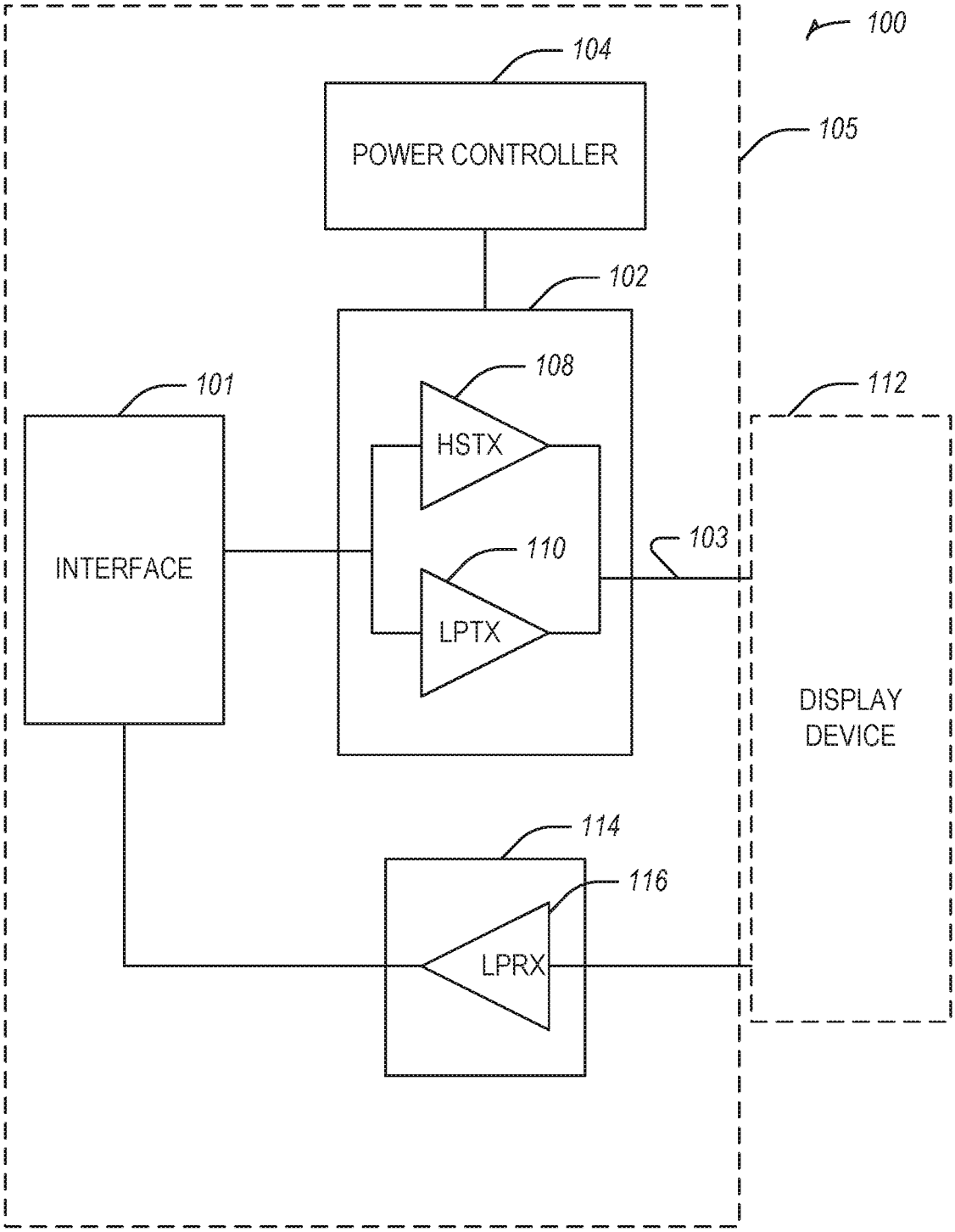
FIG. 1 illustrates a system including a display controller with an interface circuit in accordance with some embodiments.

FIG. 1 illustrates a system 100 including a display controller 105 with an interface circuit in accordance with some embodiments. The display controller 105 includes an interface circuit 101 capable of supporting multiple, different interface standards. The interface circuit 101 does not contain a separate, unique circuit for each different interface. More specifically, there does not exist a separate, isolated driver and I/O for each different interface that is supported. Rather, "transistor sharing" is exhibited within the driver circuitry 102 such that there exists within the driver 102 at least one transistor that drives the signals of more than one interface standard. Also, the driver circuitry 102 (in the particular example depicted in FIG. 1) only drives a single I/O such that the signals of all the different supported interface standards may flow through the single I/O. The display controller 105 includes a second driver component 114 including a low power receiver 116, described in detail below.

The end user of the semiconductor die is expected to select one of these standards and, by so doing, cause a particular configuration to be determined for the die. The specific configuration determines the particular type of signaling that will flow through the single I/O (i.e., the signaling specific to the particular interface that the user selected). For convenience, driver 102 represents the driver of a single lane. Those of ordinary skill will appreciate that even though only a single driver 102 is depicted, display interfaces typically allow for multiple lanes where each lane has its own respective driver. Thus, in implementation, there may be multiple drivers (one for each lane) but for ease of drawing the driver circuitry for only one lane has been depicted in FIG. 1.

In an example the driver 102 is actually a differential driver having both + and − outputs (and therefore actually drives two I/Os). In an implementation, the + driver 102 is designed to drive the + signal for each of: 1) DP; 2) eDP; 3) HDMI; 4) high speed MIPI DSI; and, 5) low speed MIPI DSI.

The driver circuitry 102 of FIG. 1 includes a first portion 108 designed to drive high speed signals, and, a second portion 110 designed to drive low power signals. According to one implementation, the high speed signals include: 1) DP (which operates with 750 mvpp signals at line speeds up to 5.4 Gbps); 2) eDP (which operates with 300 mvpp signal amplitudes at line speeds up to 5.4 Gbps); 3) HDMI (which operates with 750 mvpp signal amplitudes at line speeds up to approximately 6 Gbps); and, 4) high speed MIPI DSI (which operates with 300 mvpp signal amplitudes at line speeds up to 1.5 Gpbs) (Here, "mvpp" corresponds to "millivolts peak to peak" and "Gbps" corresponds to "Gigabits per second"). Thus, to summarize, in an implementation, the high speed portion 108 is responsible for driving signals of different interfaces but each of whose signaling characteristics may be described as having less than 1000 mvpp signal amplitude and greater than 1 Gbps line speed.

The low power portion 110 in an implementation is designed to drive a low power MIPI DSI signal that may drive signal amplitudes of 1300 mvpp but only reach speeds of up to 10 Mbps. Thus, the low power portion 110 in an implementation may be characterized as driving signals having greater than 1000 mvpp amplitude but line speeds of less than 1 Gbps (or even 0.1 Gbps).

Certain semiconductor manufacturing processes now fabricate different complementary logic technologies on a single die. For example, a semiconductor manufacturing process might fabricate both a first complementary logic composed of "thick gate" p type and n type transistors and a second complementary logic composed of "thin gate" p type and n type transistors. Thin gate transistors have thinner gate oxides than thick gate transistors. As such, thin gate transistors have larger transconductance (and therefore may exhibit higher speeds) than thick gate transistors. By contrast thick gate transistors have larger breakdown voltages (and therefore may sustain higher gate/drain and gate/source voltages) than thin gate transistors.

As such, thin gate transistors are ideal for high speed, low voltage signals while thick gate transistors are ideal for low speed, high voltage signals.

Thus, in an example, the transistors of the high-speed portion 108 are implemented with thin gate transistors, while, the transistors of the low power portion 110 are implemented with thick gate transistors. Consistent with this approach, the supply voltage provided to the pull-up/pull-down driver formed by the transistors in the low power portion 110 (having thick gate transistors to drive a signal amplitudes greater than 1000 mvpp) is greater than 1.0 V (in the particular implementation of FIG. 1, the supply voltage is 1.2 V), while, the supply voltages provided to the pull-up/pull-down driver formed by the transistors of the high-speed portion are less than 1.0 V.

Describing the operation of the high-speed portion 108 first, the high speed portion 108 may be described as having a pull-up/pull-down driver having two different types of pull-up transistors. Specifically, a first transistor of the transistors of the high-speed portion 108 corresponds to a first type of pull-up transistor (a p type pull-up transistor), a second transistor of the transistors of the high-speed portion 108 corresponds to a second type of pull-up transistor (an n type of pull-up transistor) and a third transistor of the transistors of the high-speed portion 108 corresponds to the pull-down transistor. Recalling that the high speed portion 108 in an implementation drives the signals for four different interface types (DP, eDP, HDMI and high speed MIPI DSI), the different interfaces themselves may specify different peak-to-peak voltages, which, in turn, may be handled by supplying the pull-up transistors with different supply voltages, where, a specific one of the types of pull-up transistors is used with a specific one of the supply voltages.

In particular, in an implementation where the DP and HDMI signals have 750 mvpp amplitudes and the eDP and high speed MIPI DSI signals have 300 mvpp amplitudes, a 1.0 V supply voltage is supplied to the first transistor of the transistors of the high-speed portion 108 pull-up transistor for DP and HDMI signals, whereas, a 0.4 V supply voltage is supplied to the second transistor of the transistors of the high-speed portion 108 pull-up transistor for eDP and MIPI DSI signals. Here, a buffer that drives the high speed pull-up/pull down transistors has: 1) a first "DP/HDMI" state that drives DP or HDMI data signals on a first line while providing a voltage on a second line that places the second transistor of the transistors of the high-speed portion 108 in an off state; and, 2) a second "eDP/high speed MIPI DSI state" that drives eDP or high speed MIPI DSI data signals on the second line while providing a voltage on the first line that places the first transistor of the transistors of the high-speed portion 108 in an off state. Data signals of all types (DP, HDMI, eDP and high speed MIPI DSI) are placed on a third line regardless of which of the first and second lines is enabled to carry data (i.e., the first line in the DP/HDMI state or the second line in the eDP/high speed MIPI DSI state).

Note that the first transistor of the transistors of the high-speed portion 108 is a p type transistor while the second transistor of the transistors of the high-speed portion 108 is an n type transistor. Because of the use of different pull up transistor polarities, different logical schemes are used for the two different states of the buffer discussed above. In particular, since the first transistor of the transistors of the high-speed portion 108 is a p type pull-up transistor, when in the first (DP/HDMI) state, signals are placed on the first line that are logically the same as the signals that are placed on the third line. That is, when a logic "high" is presented on the third line (to turn the third transistor of the transistors of the high-speed portion 108 "on" and pull down the logic level on output line 103) a logic "high" is also presented on the first line (to turn the first transistor of the transistors of the high-speed portion 108 "off" to prevent the 1.0 V supply voltage from influencing the output line 103). Likewise, when a logic "low" is presented on the third line (to turn the third transistor of the transistors of the high-speed portion 108 "off" to prevent the ground reference from influencing output line 103) a logic "low" is also presented on the first line (to turn the first transistor of the transistors of the high-speed portion 108 "on" to drive output line 103 with the 1.0 V supply voltage). The output line 103 goes to a display device 112 for controlling the display device 112. The display device 112 is optional in the system 100.

By contrast, when operating in the second (eDP/high speed MIPI DSI) state, signals are placed on the first line that are logically opposite to the signals that are placed on the third line. That is, when a logic "high" is presented on the third line (to turn the third transistor of the transistors of the high-speed portion 108 "on" and pull down the logic level on output line 103) a logic "low" is also presented on the second line (to turn the second transistor of the transistors of the high-speed portion 108 "off" to prevent the 0.4 V supply voltage from influencing the output line 103). Likewise, when a logic "low" is presented on the third line (to turn the third transistor of the transistors of the high-speed portion 108 "off" to prevent the ground reference from influencing output line 103) a logic "high" is presented on the second line (to turn the second transistor of the transistors of the high-speed portion 108 "on" to drive output line 103 with the applied voltage on the second line less the gate-source forward bias voltage. In an example, the applied voltage on the second line for a logic high in the eDP/high speed MIPI DSI state is 1.05 V. Accounting for a gate-to-source forward bias drop of 0.65 V for the second transistor of the transistors of the high-speed portion 108, exactly 0.3 V is driven on output line 103.

In an example, a low drop out voltage regulator is used to supply 1.0 V or 0.4 to the first or second transistors of the transistors of the high-speed portion 108 network depending on whether the buffer is in the DP/HDMI state or the eDP/high speed MIPI DSI state (1.0 V in the case of the former, 0.4 V in the case of the later).

Referring to the low power portion 110, a standard pull-up/pull-down driver is observed with thick gate transistors the transistors of the low power portion 108. The pull-up/pull-down driver is driven by a buffer. Both the buffer and the driver are supplied with a 1.2 V supply voltage. When the low power portion 110 is activated to enable the low power MIPI interface, the buffer within the high speed portion 108 enters a high output impedance state A problem, however, is that the low power portion 110 may drive output line 103 to reach voltages as high as 1.3 V (because the 1.2 V supply voltage may actually reach 1.3 V in worst case circumstances). Recalling that transistors within the high speed portion 108 are thin gate transistors and therefore have lower gate dielectric breakdown voltages, without any protective circuitry, transistors of the high-speed portion 108 could conceivably suffer gate dielectric breakdown if the low power portion 110 were to drive output line 103 to 1.3 V.

Figure 2:
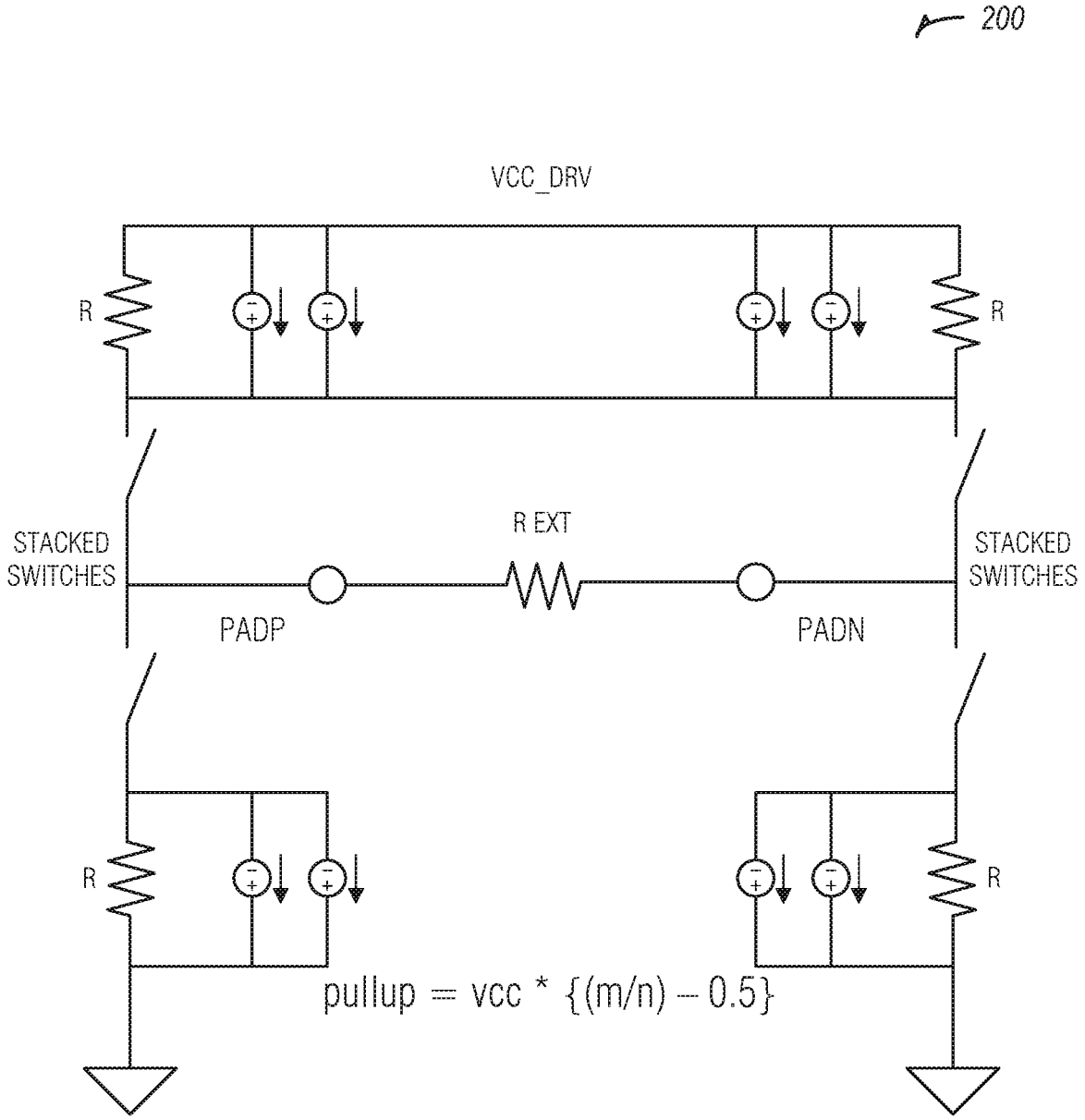
FIG. 2 illustrates an architecture level diagram of a high speed driver for an interface circuit in accordance with some embodiments.

FIG. 2 illustrates an architecture level diagram 200 of a high speed driver for an interface circuit in accordance with some embodiments. The diagram 200 includes a MIPI-DSI CKT architecture with thin gates. The high speed transmitter shown in diagram 200 includes stacked switches.

In an example, the architecture level diagram 200 includes a thin gate combined eDP-MIPI DSI architecture with a stacked design. The architecture level diagram 200 includes a second driver circuit to provide the – signal component of the differential signal. An output switch may be nominally "open" in most modes to isolate the + and – channels. When the driver is configured to drive eDP signals, the output switch may be "closed" to provide capacitive coupling between the + and – channels that properly shapes the eDP output signal in terms of both pre-emphasis and voltage swing. A switch control is used to control the output switch in accordance with whether the eDP mode has been selected or in. As such, the switch control may also be coupled to the aforementioned register space.

An example includes a voltage mode differential transmitter with calibrated TX termination. The switches shown in the architecture level diagram 200 may be equivalent to stacked thin gate transistor based pass gates, designed to operate at swings as low as 400 mV differential with a common mode of 200 mV. The swing may be controlled by driver LDO shown as vccdrv in the architecture level diagram 200. When a high speed transmitter (HSTX) is functioning, the stacked devices connected to pad may be turned on completely and the TX switching may be controlled by mos devices in series. In an example, a low power transmitter (LPTX) is kept in high impedance state during HSTX operation.

Figure 3:
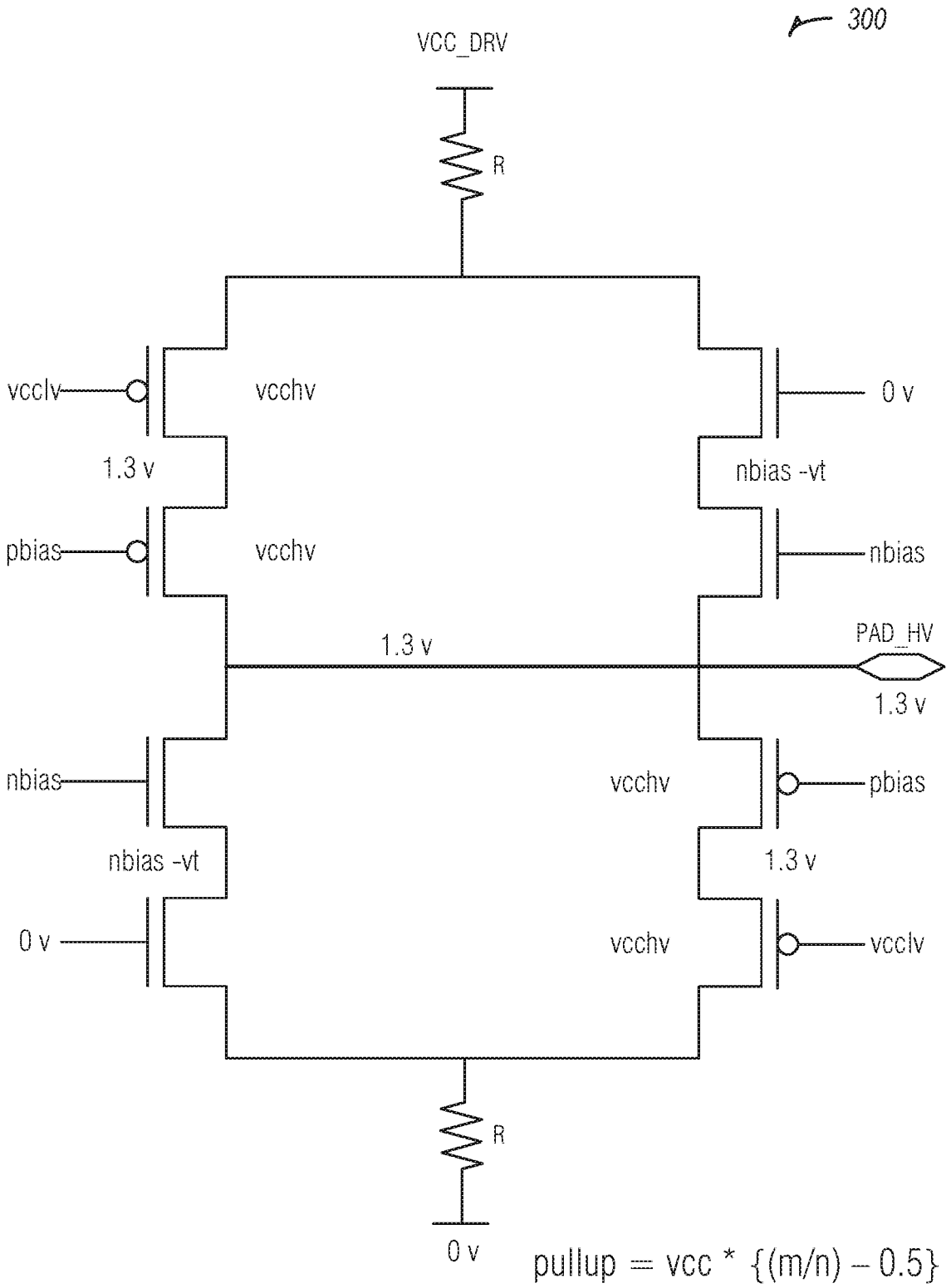
FIG. 3 illustrates a transistor level diagram of a high speed driver for an interface circuit in accordance with some embodiments.

FIG. 3 illustrates a transistor level diagram 300 of a high speed driver for an interface circuit in accordance with some embodiments. The diagram 300 includes a stacked driver structure for an EOS solution. In an example, when the LPTX is operating and the pad toggles at high voltage (HV), the HSTX is maintained in high impedance state with EOS protection enabled. The stacked devices of HSTX for PMOS and NMOS may be biased appropriately as shown in the transistor level diagram 300, such as to maintain the Vgd, Vgs, Vdb and Vsb below the process EOS limits. The sizing of the pass gate devices may be precisely calculated to meet the TX impedance.

Figure 4:
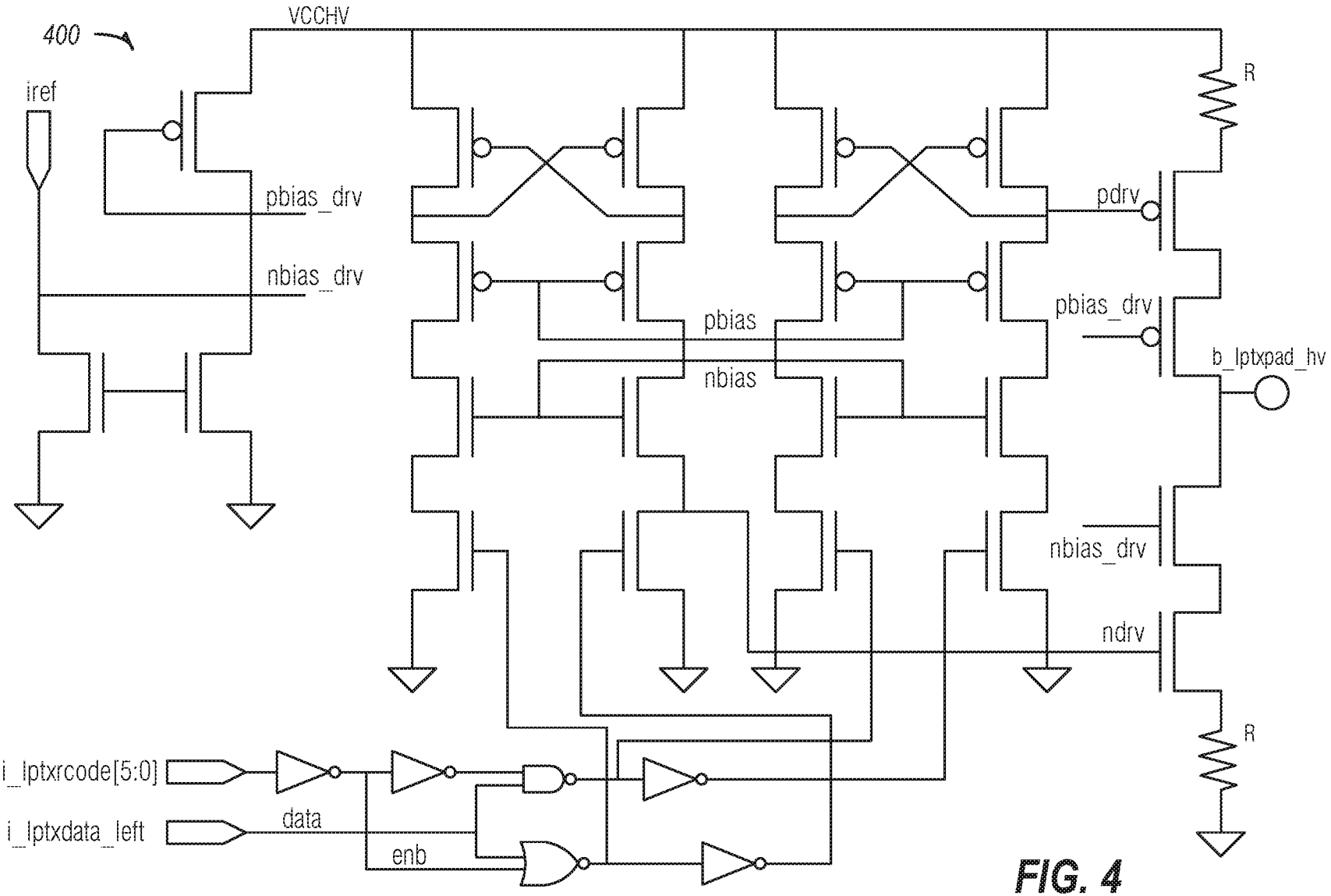
FIG. 4 illustrates a low power transmitter in accordance with some embodiments.

FIG. 4 illustrates a low power transmitter 400 in accordance with some embodiments. The low power transmitter 400 includes MIPI LPTX architecture with a thin gate driver, is EOS compliant, and includes a slew rate control. Protective circuits are introduced to a high speed portion to ensure that the gate dielectrics of transistors of a high-speed transmitter do not exceed their associated breakdown voltages. Protective circuits are essentially switch circuits that, under the control of control signal are "open" to permit a protective bias voltage on the lines when the low power transmitter 400 is enabled, or, "closed" to prevent the protective bias voltages from reaching the lines when the high speed portion is active.

A protective circuit supplies the first line with a voltage of 1.05 V when the low power transmitter 400 is enabled. As such, when the low power portion drives an output line to the ground reference, a bias of only 1.05 V is placed across the drain/source junction of a first transistor of the transistors of the high-speed portion which is within the breakdown voltage rating for the thin gate transistors. Likewise, protective circuits drive the second and third lines respectively to 0.15 V when the low power portion is enabled. Should the low power transmitter 400 drive the output line to a worst case 1.3 V, the gate-source junction voltage of a second transistor of the transistors of the high-speed portion and the gate-drain voltage of a third transistor of the transistors of the high-speed portion will only reach a voltage of 1.15 V which is also within the breakdown specification of the thin gate transistors. Thus, with the help of the protective circuits, high speed and low power portions may be integrated into a single driver.

The MIPI-DSI LPTX may be used for handshake operations between a MIPI-DSI panel and a MIPI I/O. In an example, the signaling may be at 10 MBPS with VOH specified between 1.1 V to 1.3 V. The low power transmitter 400 below shows an implementation of a stacked frontend driver for CMOS signaling powered by VCCHV which may be maintained >=1.1 V and <=1.3 V. The stacked devices in the driver for the low power transmitter 400 may be biased. In an example, for a minimum slew rate requirement, the biases may turn on, with voltages lower than EOS limits of the devices. In another example, for a case of slew rate control enabled, the stacked devices may be throttled to control the drive slopes through pbias_drv and nbias_drv. The predrivers may be stacked level shifters and are biased to meet EOS limits.

Figure 5:
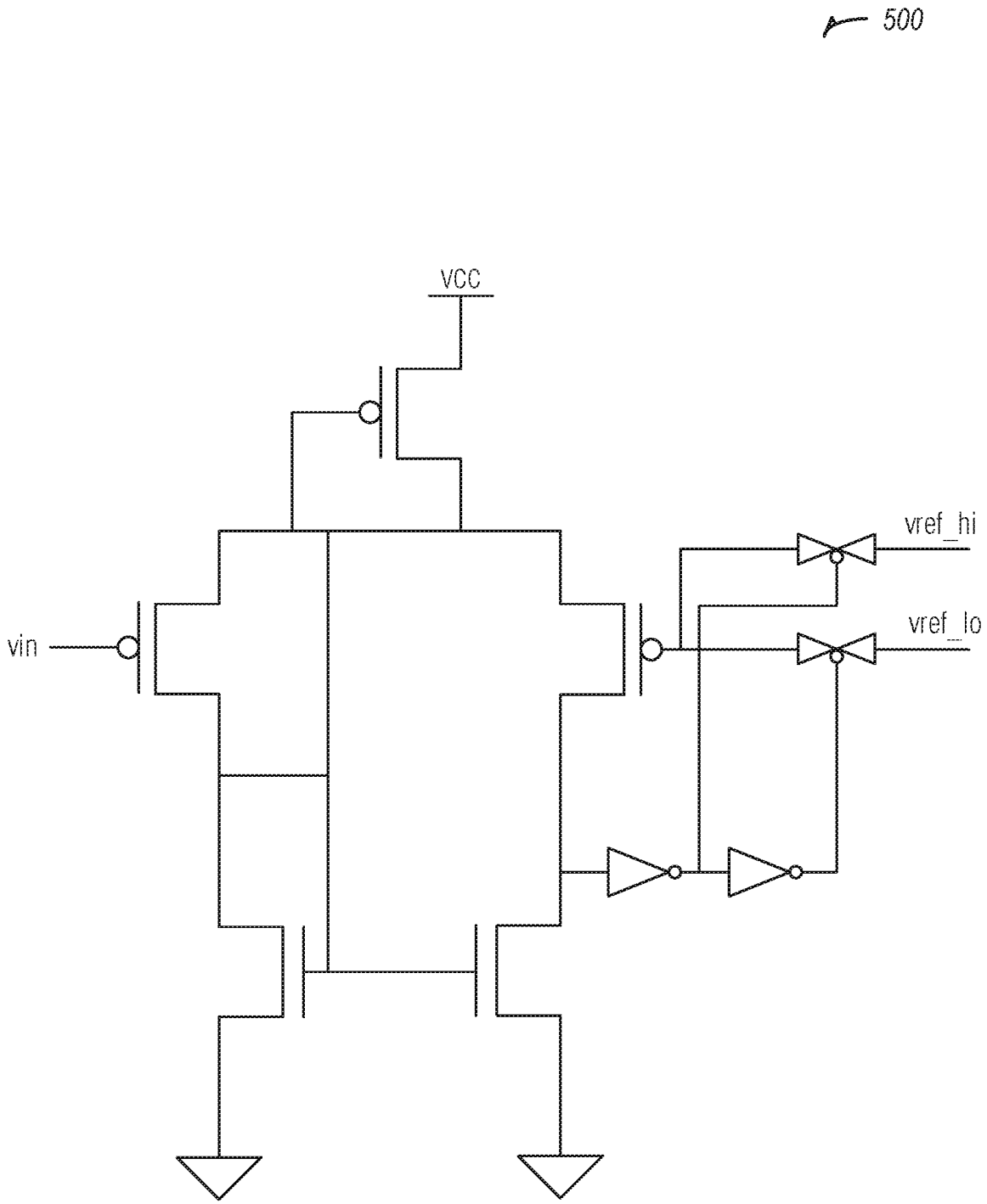
FIG. 5 illustrates a low power receiver in accordance with some embodiments.

FIG. 5 illustrates a low power receiver 500 in accordance with some embodiments. The low power receiver 500 includes a MIPI RX circuit architecture with EOS protection.

The low power receiver 500 may be separate from a low power transmitter. In an example, conventional Schmitt trigger circuits may not be able to meet the stringent input sensitivity requirements of the MIPI LPRX across different process, voltage and temperature ranges. The low power receiver 500 includes reference voltage based-self-biased input stages, designed to be more robust to PVT variations. The VREF_HI and VREF_LO may be adjusted based on the required input thresholds for LPRX. The Vih, Vil and Vhys are dependent on these voltages which are derived from supply voltage using a resistor ladder. The low power receiver 500 is more robust compared to conventional Schmitt trigger for PVT sensitivity.

Figure 6:
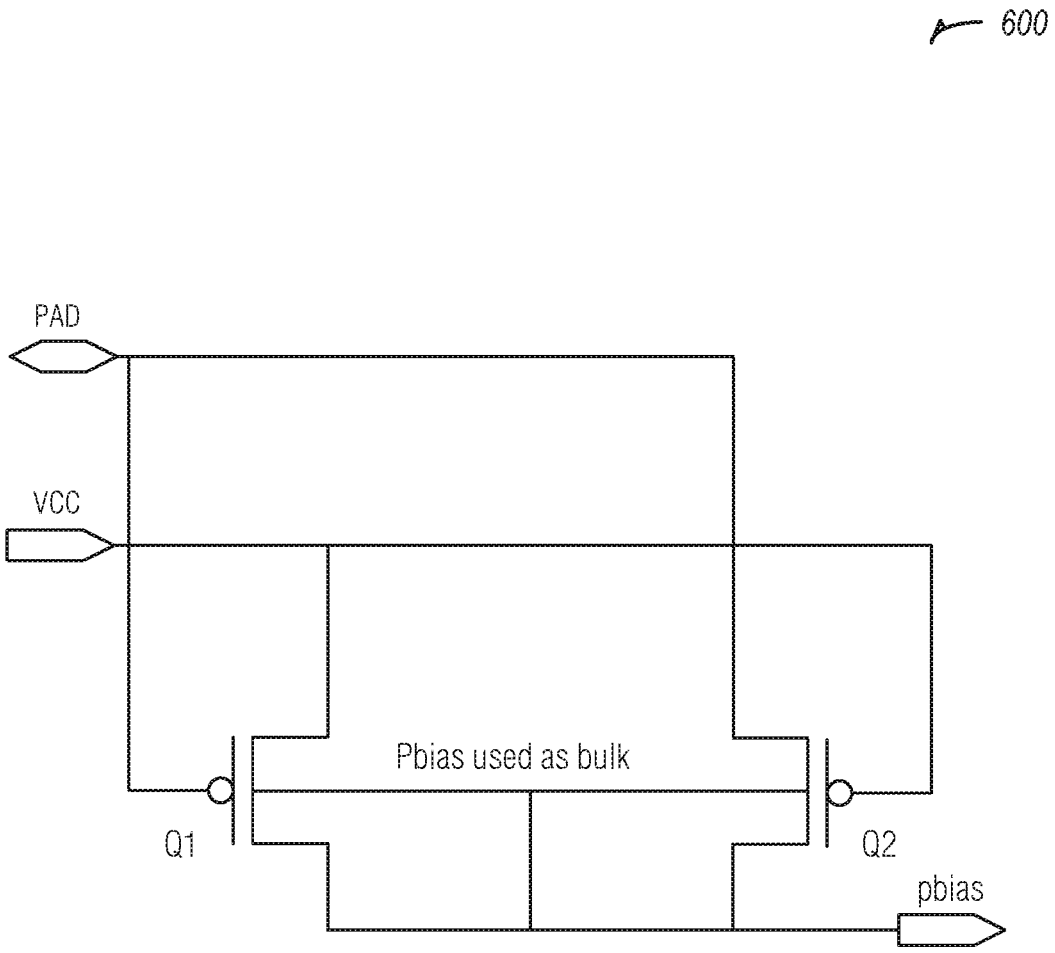
FIG. 6 illustrates a pad tracking protection circuit in accordance with some embodiments.

FIG. 6 illustrates a pad tracking protection circuit 600 in accordance with some embodiments. The pad tracking protection circuit 600 operates to control the pad voltage. For example, when the MIPI lane is in receive mode and the panel side is transmitting data, the pad voltage may go as high as 1.3 V. Since the supply voltage range is lower than this level, there may be a bulk violation if the bulk is connected to the supply and pad voltage is higher than bulk. The pad tracking protection circuit 600 may be used to avoid or prevent the bulk violation. For example, to avoid or prevent the bulk violation, the pad tracking protection circuit 600 may be configured to turn Q1 ON and set VBULK=VPAD if VPAD>VCC and turn Q2 ON and set VBULK=VCC if VCC>VPAD. The bulk nodes of the transistors may be connected to the derived voltage VBULK, which gets the highest voltage among the VPAD and VCC. The pad tracking protection circuit 600 avoids or prevents the bulk getting forward biasing when the PAD voltage goes to 1.3 V.

Table 1 below illustrates different states of the driver in accordance with some embodiments. Table 1 provides a chart showing the different states of the driver. In the low power MIPI state, active data signals are provided to transistors of a low power transmitter, the protective circuits are in a closed state and the high speed driver portion is in a high output impedance state. In the high speed state, buffer turns transistors of the low power transmitter off. The high speed state has two sub states: DP/HDMI and eDP/high speed MIPI DSI. In the DP/HDMI state, the voltage regulator provides a 1.0 V to the high speed pull-up/pull-down driver and the buffer drives active data signals into a first and third transistor of a high-speed transmitter, and a second transistor of the high-speed transmitter is off. In the eDP/high speed MIPI DSI state, the voltage regulator provides 0.4 V to the pull-up/pull-down driver, active data signals are provided to the second and third transistor of the high-speed transmitter, while the first transistor of the high-speed transmitter is off. The different states may be effected with control register space of one or more control registers of the display controller (not shown) that may be set, e.g., through software. The control register(s) are coupled to the buffers which effect the different states of the driver as depicted in Table 1 in response.

TABLE 1

| Driver States | | |
|---|---|---|
| Thingate Features | Blocks Implemented | Description |
| Enabling High performance TX | HSTX | Stacked differential TX with optimal pad cap |

TABLE 1-continued

| Driver States | | |
|---|---|---|
| Thingate Features | Blocks Implemented | Description |
| Enabling High voltage Low | LPTX | Stacked single ended TX |
| Enabling Slew rate Spec | HSTX, LPTX | Bias Based slew rate control in pre-driver for HSTX and final LPTX AFE |
| Enabling EOS Compliant Combo eDP-MIPI DSI PHY | HSTX, LPTX, LPRX, HVPG | Stacked Architecture for TX AFE and high voltage pad tracking CKT for pad leakage reduction |

The combination eDP MIPI DSI driver may include a common clock & data path and a common configurable HSTX. In an example, a common HSTX may support data rates up to 8.1 GBPS for eDP and up to 1.5 GBPS for MIPI-DSI. In another example, a HSTC included in the combination driver may support a MIPI DSI specification allows for up to is 4.5 GBPS.

In an example, for supporting MIPI DSI LPTX, each pad may be integrated with a stacked low power driver in the same analog I/O block. In another example, LPTX may be disabled during eDP operation. In an example, the HSTX swings, common mode and AC common mode ripple may be controlled by cleaner programmable supply through an inbuilt LDO.

Figure 7:
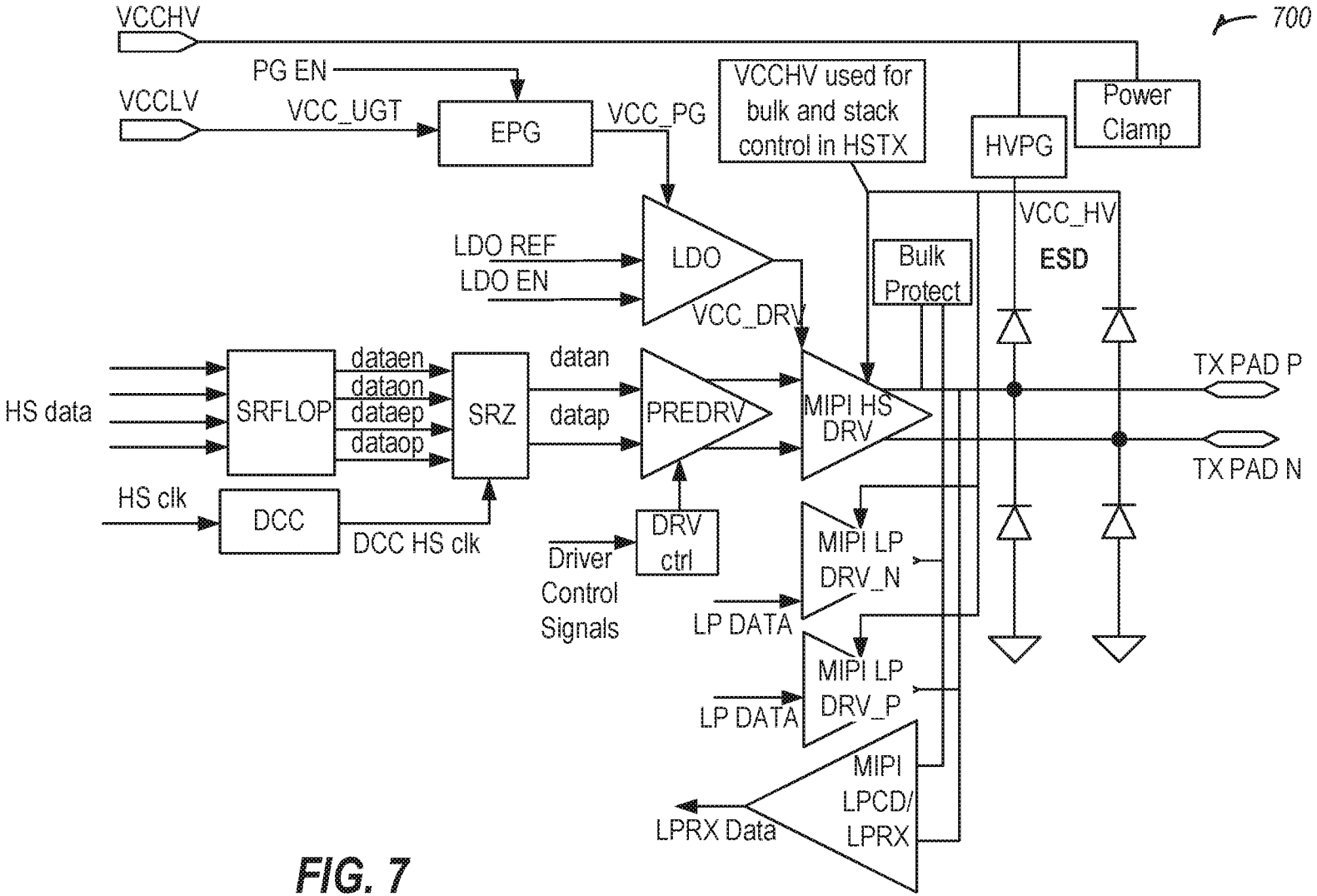
FIG. 7 illustrates a fully differential driver in accordance with some embodiments.

FIG. 7 illustrates a driver system 700 in accordance with some embodiments. The driver system 700 includes an interface circuit that may be used to process data presented from the display controller core to the driver. The data may be presented to a PHY channel logic either serially or in parallel words depending on the specific display interface that has been selected. For example, DP and eDP data is presented to the PHY channel in 10 bit wide parallel words, while HDMI and MIPI data is presented to the PHY channel as a serial data stream. As such there exists in the PHY parallel to serial conversion circuitry that is used in the PHY channel for DP and eDP configurations but is bypassed for HDMI and MIPI configurations.

Importantly the display controller discussed herein may be instantiated into a semiconductor chip that is designed to interface with a display. Examples include media system on chips (SOCs), processors (including multi-core processors), application specific integrated circuits (ASICs), Display protocol converters (CE) among a multitude of other possible applications. The combination eDP MIPI DSI I/O allows an OEM to choose an embedded panel at time of manufacture. The combination may include cost savings in terms of die area and bumps. In an example, the combination eDP MIPI DSI driver may support 4K/5K/8K embedded panels, where the eDP data rate required may be 5.4 Gbps/8.1 Gbps, which may not be designed with the thick gate.

Figure 8A:
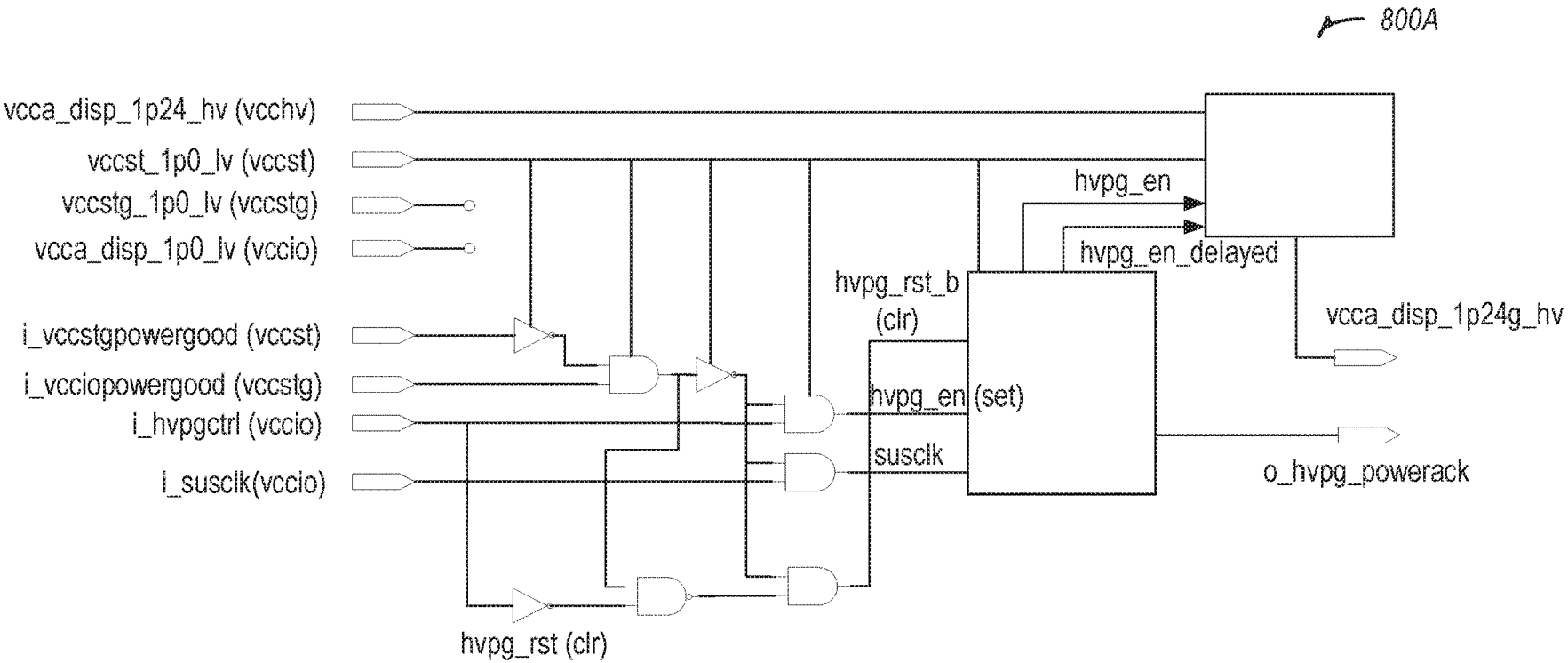
FIGS. 8A-8B illustrate an architecture level diagram and an example waveform of a high voltage power gate for low power transmission supply in accordance with some embodiments.
Figure 8B:
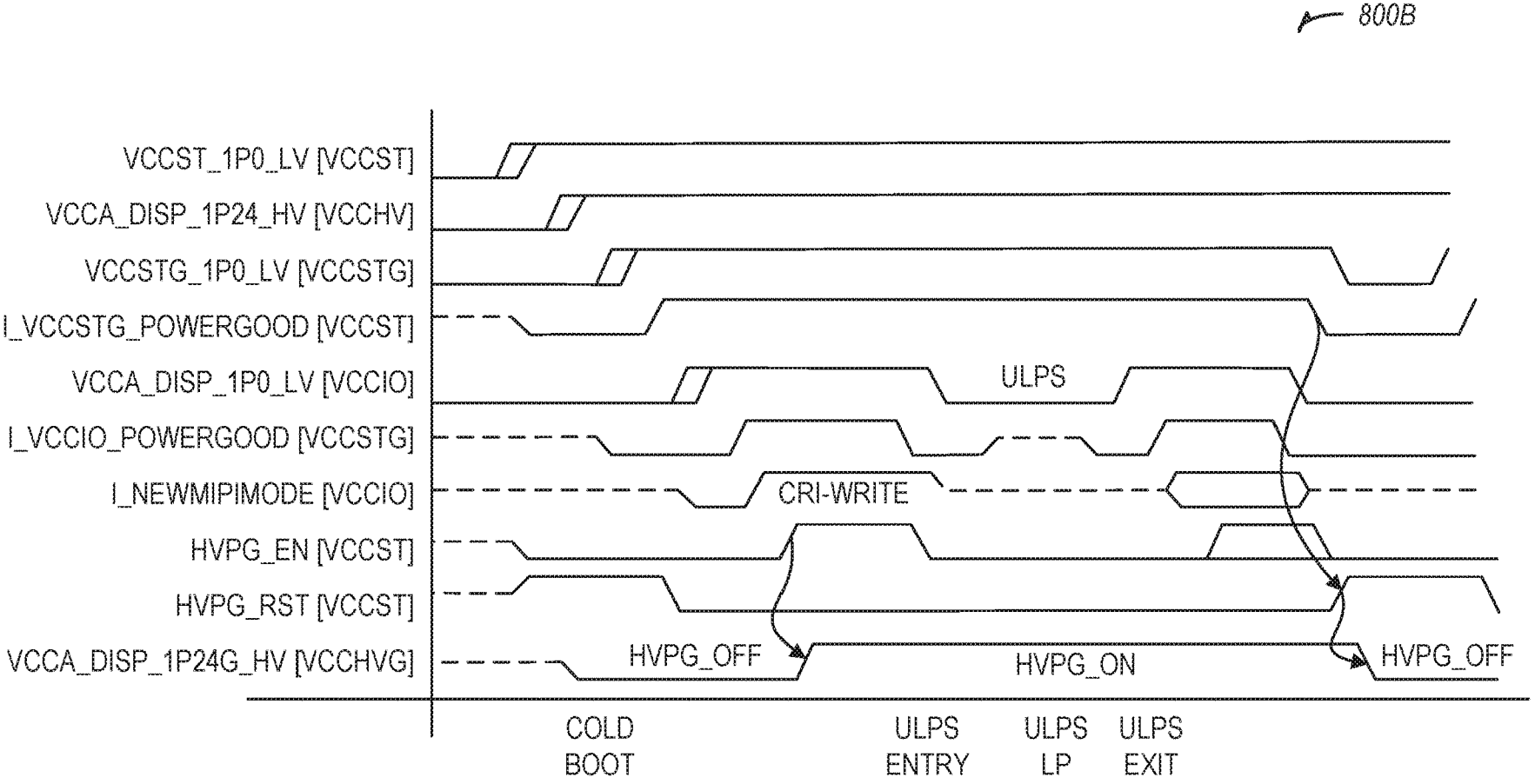

FIGS. 8A-8B illustrate an architecture level diagram 800A and an example signal diagram 800B of a high voltage power gate for low power transmission supply in accordance with some embodiments. The diagrams 800A and 800B illustrate high voltage power gate architecture with thin gate transistors and signals for a LPTX supply. In an example, the architecture in the architecture level diagram 800A supports lower power modes. For example, the architecture level diagram 800A may be used when a high voltage (HV) supply is turned on after a low voltage (LV) power supply.

In an example, the architecture level diagram 800A shows the a block diagram of a HV power gate that is built with stacked Pmos and Nmos switches to protect EOS and control the HV power gate output ramp rates. For example, on HV power gate enable, a soft start lock may turn on the Nmos only stack that charges the output supply to VCC/2 at a slower ramp, followed by a weak Pmos bank that ramps the voltage to VCCHV. In an example, the main Pmos bank may be turned on to supply the full load current. The detailed sequence is illustrated in the example signal diagram 800B.

Figure 9:
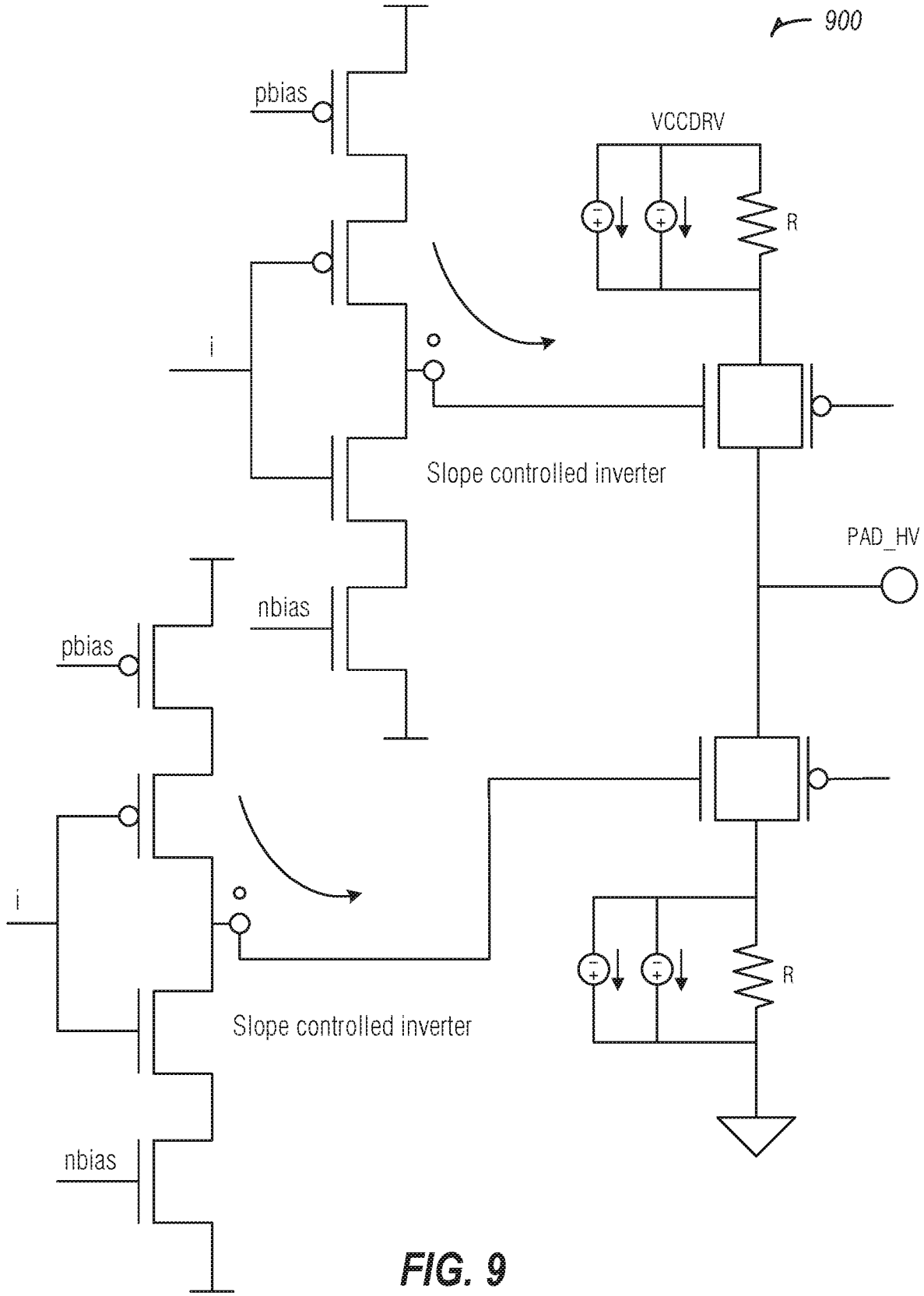
FIG. 9 illustrates a slew rate control diagram for a high speed driver in accordance with some embodiments.

FIG. 9 illustrates a slew rate control diagram 900 for a high speed driver in accordance with some embodiments. In an example, the slew rate control diagram 900 includes circuitry to meet a slew rate specification. In another example, the slew rate control diagram 900 includes circuitry to control the slew rate for a high speed transmitter, such as one conforming to a specification for MIPI DSI, such as to retain the EMI/EMC under control. For example, maintaining slower slopes (e.g., 150 ps to 233 pS) for MIPI data rates below 1 Gbps and faster slopes for eDP 5.4 gbps (e.g., <50 pS) and higher data rates is often a challenge with common TX. The slew rate control diagram 900 circuitry controls the slope of the predriver, by controlling the stacked device currents to meet the challenge. In an example, a programmable bias generates control voltage when in MIPI DSI mode and turns on the stack transistor with full overdrive when in eDP mode. In another example, the throttled currents on the predriver maintain slower slopes on the predriver output, which are used to control final driver slopes.

Figure 10:
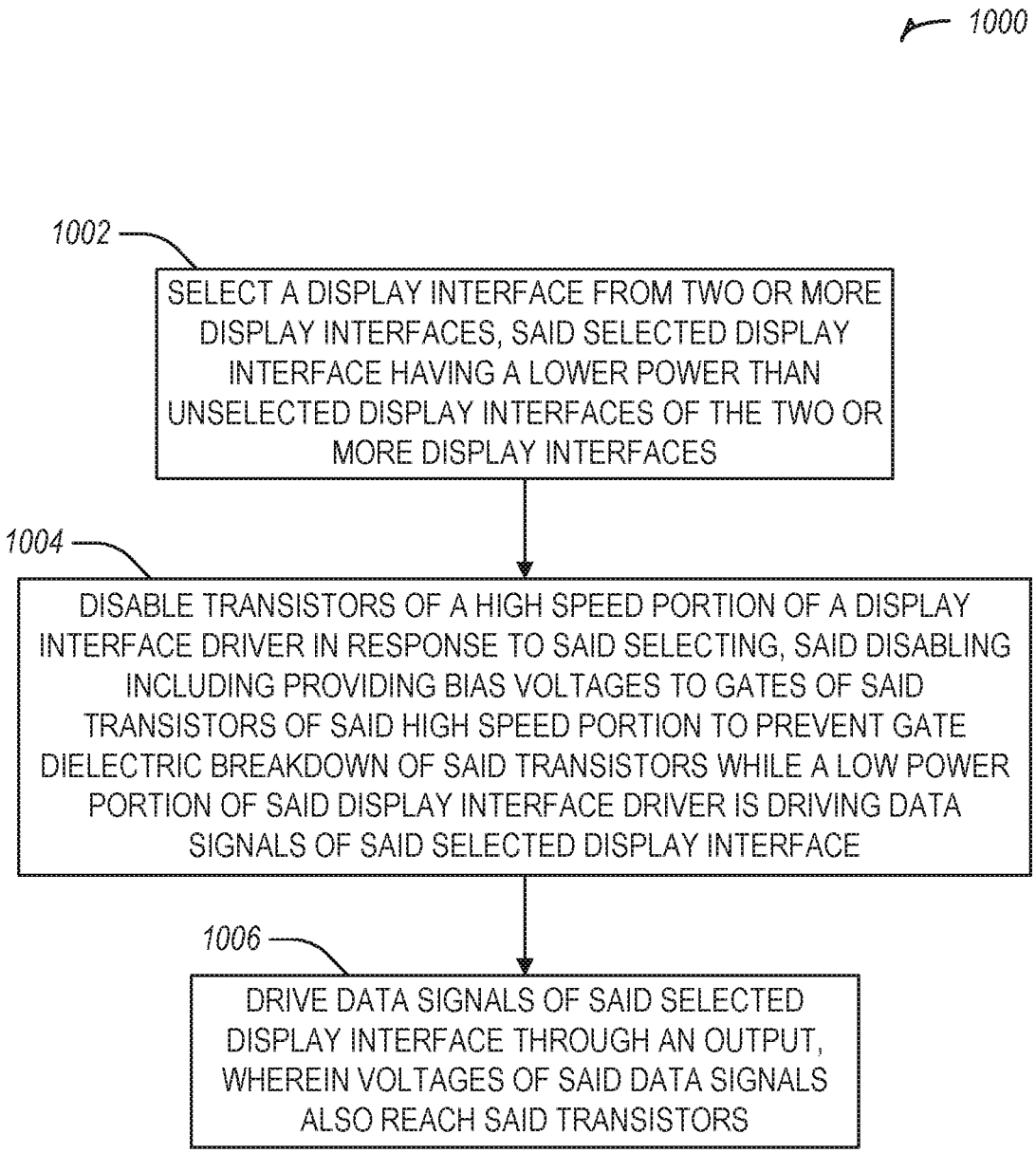
FIG. 10 illustrates a flow chart showing a technique for selecting among display interfaces in accordance with some embodiments.

FIG. 10 illustrates a flowchart showing a technique 1000 for selecting among display interfaces in accordance with some embodiments. The technique 1000 includes an operation 1002 to select a display interface from two or more display interfaces, said selected display interface having a lower power than unselected display interfaces of the two or more display interfaces. In an example, the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI. In another example, the display interface comprises a PHY channel coupled in front of the display interface driver, the PHY channel having a path comprising a parallel to serial converter to process data of one of the two or more display interfaces received at the PHY channel as parallel words. In an example, the PHY channel has a bypass path that causes data of another one of the two or more display interfaces to bypass the parallel to serial converter, the data of the another one of the two or more display interfaces received at the PHY channel as a serial stream.

The technique 1000 includes an operation 1004 to disable transistors of a high speed portion of a display interface driver in response to said selecting, said disabling including providing bias voltages to gates of said transistors of said high speed portion to prevent gate dielectric breakdown of said transistors while a low power portion of said display interface driver is driving data signals of said selected display interface. In an example, the high speed portion of the display interface driver is a high speed pull-up/pull-down driver and includes transistors whose gate dielectrics are thinner than transistors of the low power portion of the display interface driver, which is a low power pull-up/pull-down driver. In an example, the transistors of the high speed portion of the display interface driver are coupled to protective switch circuits that provide respective protective bias voltages to prevent dielectric breakdown when the low speed pull-up/pull-down driver is active. In an example, the high speed portion of the display interface driver comprises first and second pull-up transistors, the first pull-up transistor to drive data for a first subset of the two or more display interfaces, the second pull-up transistor to drive data for a second subset of the two or more display interfaces.

The technique 1000 includes an operation 1006 to drive data signals of said selected display interface through an output, wherein voltages of said data signals also reach said transistors. In an example, the display interface driver and the two or more display interfaces may be cointegrated using a common semiconductor integrated circuit die or cointegrated in a single integrated circuit package. The technique 1000 may include an operation to provide a first one of the respective protective bias voltages to a p type pull-up transistor and providing a second one of the bias voltages to an n type pull-up transistor.

VARIOUS NOTES & EXAMPLES

Each of these non-limiting examples may stand on its own, or may be combined in various permutations or combinations with one or more of the other examples.

Example 1 is an integrated circuit, comprising: a display controller having a driver, the display controller being configurable to select amongst two or more display interfaces, the driver designed to drive respective signals for each of the two or more display interfaces through a single output; the driver comprising a high speed pull-up/pull-down driver and a low power pull-up/pull-down driver whose respective outputs are coupled to the output; and wherein the high speed pull-up/pull-down driver includes transistors whose gate dielectrics are thinner than transistors of the low power pull-up/pull-down driver.

In Example 2, the subject matter of Example 1 optionally includes wherein the display controller is configured to, when a first display interface of the two or more display interfaces is selected, disable other display interfaces of the two or more display interfaces.

In Example 3, the subject matter of any one or more of Examples 1-2 optionally include wherein the transistors of the high speed pull-up/pull-down driver are coupled to protective switch circuits that provide respective protective bias voltages to prevent dielectric breakdown when the low speed pull-up/pull-down driver is active.

In Example 4, the subject matter of Example 3 optionally includes wherein the display controller is configured to provide a first one of the respective protective bias voltages to a p type pull-up transistor and to provide a second one of the bias voltages to an n type pull-up transistor.

In Example 5, the subject matter of any one or more of Examples 1-4 optionally include wherein the high speed pull-up/pull-down driver comprises first and second pull-up transistors, the first pull-up transistor to drive data for a first subset of the two or more display interfaces, the second pull-up transistor to drive data for a second subset of the two or more display interfaces.

In Example 6, the subject matter of any one or more of Examples 1-5 optionally include wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

In Example 7, the subject matter of any one or more of Examples 1-6 optionally include wherein the display controller comprises a PHY channel coupled in front of the driver, the PHY channel having a path comprising a parallel to serial converter to process data of one of the two or more display interfaces received at the PHY channel as parallel words.

In Example 8, the subject matter of Example 7 optionally includes wherein the PHY channel has a bypass path that causes data of another one of the two or more display interfaces to bypass the parallel to serial converter, the data of the another one of the two or more display interfaces received at the PHY channel as a serial stream.

In Example 9, the subject matter of any one or more of Examples 1-8 optionally include wherein the driver and the two or more display interfaces are cointegrated using a common semiconductor integrated circuit die.

In Example 10, the subject matter of any one or more of Examples 1-9 optionally include wherein the driver and the two or more display interfaces are cointegrated in a single integrated circuit package.

Example 11 is a method for selecting amongst multiple display interfaces, comprising: selecting a display interface from two or more display interfaces, the selected display interface having a lower power than unselected display interfaces of the two or more display interfaces; disabling transistors of a high speed portion of a display interface driver in response to the selecting, the disabling including providing bias voltages to gates of the transistors of the high speed portion to prevent gate dielectric breakdown of the transistors while a low power portion of the display interface driver is driving data signals of the selected display interface, and driving data signals of the selected display interface through an output, wherein voltages of the data signals also reach the transistors.

In Example 12, the subject matter of Example 11 optionally includes wherein the high speed portion of the display interface driver is a high speed pull-up/pull-down driver and includes transistors whose gate dielectrics are thinner than transistors of the low power portion of the display interface driver, which is a low power pull-up/pull-down driver.

In Example 13, the subject matter of any one or more of Examples 11-12 optionally include wherein the transistors of the high speed portion of the display interface driver are coupled to protective switch circuits that provide respective protective bias voltages to prevent dielectric breakdown when the low speed pull-up/pull-down driver is active.

In Example 14, the subject matter of Example 13 optionally includes providing a first one of the respective protective bias voltages to a p type pull-up transistor and providing a second one of the bias voltages to an n type pull-up transistor.

In Example 15, the subject matter of any one or more of Examples 11-14 optionally include wherein the high speed portion of the display interface driver comprises first and second pull-up transistors, the first pull-up transistor to drive data for a first subset of the two or more display interfaces, the second pull-up transistor to drive data for a second subset of the two or more display interfaces.

In Example 16, the subject matter of any one or more of Examples 11-15 optionally include wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

In Example 17, the subject matter of any one or more of Examples 11-16 optionally include wherein the display interface comprises a PHY channel coupled in front of the display interface driver, the PHY channel having a path comprising a parallel to serial converter to process data of one of the two or more display interfaces received at the PHY channel as parallel words.

In Example 18, the subject matter of Example 17 optionally includes wherein the PHY channel has a bypass path that causes data of another one of the two or more display interfaces to bypass the parallel to serial converter, the data of the another one of the two or more display interfaces received at the PHY channel as a serial stream.

In Example 19, the subject matter of any one or more of Examples 11-18 optionally include wherein the display interface driver and the two or more display interfaces are cointegrated using a common semiconductor integrated circuit die.

In Example 20, the subject matter of any one or more of Examples 11-19 optionally include wherein the display interface driver and the two or more display interfaces are cointegrated in a single integrated circuit package.

Example 21 is at least one machine-readable medium including instructions for operation of a computing system, which when executed by a machine, cause the machine to perform operations of any of the methods of Examples 11-20.

Example 22 is an apparatus comprising means for performing any of the methods of Examples 11-20.

Example 23 is a computing system comprising: a graphics controller; and a display controller coupled to the graphics controller, the display controller having a driver, the display controller being configurable to select amongst two or more display interfaces, the driver designed to drive respective signals for each of the two or more display interfaces through a single output; the driver comprising a high speed pull-up/pull-down driver and a low power pull-up/pull-down driver whose respective outputs are coupled to the output; and wherein the high speed pull-up/pull-down driver includes transistors whose gate dielectrics are thinner than transistors of the low power pull-up/pull-down driver.

In Example 24, the subject matter of Example 23 optionally includes wherein the display controller is configured to, when a first display interface of the two or more display interfaces is selected, disable other display interfaces of the two or more display interfaces.

In Example 25, the subject matter of any one or more of Examples 23-24 optionally include wherein the transistors of the high speed pull-up/pull-down driver are coupled to protective switch circuits that provide respective protective bias voltages to prevent dielectric breakdown when the low speed pull-up/pull-down driver is active.

In Example 26, the subject matter of Example 25 optionally includes wherein the display controller is configured to provide a first one of the respective protective bias voltages to a p type pull-up transistor and to provide a second one of the bias voltages to an n type pull-up transistor.

In Example 27, the subject matter of any one or more of Examples 23-26 optionally include wherein the high speed pull-up/pull-down driver comprises first and second pull-up transistors, the first pull-up transistor to drive data for a first subset of the two or more display interfaces, the second pull-up transistor to drive data for a second subset of the two or more display interfaces.

In Example 28, the subject matter of any one or more of Examples 23-27 optionally include wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

In Example 29, the subject matter of any one or more of Examples 23-28 optionally include wherein the display controller comprises a PHY channel coupled in front of the driver, the PHY channel having a path comprising a parallel to serial converter to process data of one of the two or more display interfaces received at the PHY channel as parallel words.

In Example 30, the subject matter of Example 29 optionally includes wherein the PHY channel has a bypass path that causes data of another one of the two or more display interfaces to bypass the parallel to serial converter, the data of the another one of the two or more display interfaces received at the PHY channel as a serial stream.

In Example 31, the subject matter of any one or more of Examples 23-30 optionally include wherein the driver and the two or more display interfaces are cointegrated using a common semiconductor integrated circuit die.

In Example 32, the subject matter of any one or more of Examples 23-31 optionally include wherein the driver and the two or more display interfaces are cointegrated in a single integrated circuit package.

Example 33 is an apparatus for selecting amongst multiple display interfaces, comprising: means for selecting a display interface from two or more display interfaces, the selected display interface having a lower power than unselected display interfaces of the two or more display interfaces; means for disabling transistors of a high speed portion of a display interface driver in response to the selecting, the disabling including providing bias voltages to gates of the transistors of the high speed portion to prevent gate dielectric breakdown of the transistors while a low power portion of the display interface driver is driving data signals of the selected display interface; and means for driving data signals of the selected display interface through an output, wherein voltages of the data signals also reach the transistors.

In Example 34, the subject matter of Example 33 optionally includes wherein the high speed portion of the display interface driver is a high speed pull-up/pull-down driver and includes transistors whose gate dielectrics are thinner than transistors of the low power portion of the display interface driver, which is a low power pull-up/pull-down driver.

In Example 35, the subject matter of any one or more of Examples 33-34 optionally include wherein the transistors of the high speed portion of the display interface driver are coupled to protective switch circuits that provide respective protective bias voltages to prevent dielectric breakdown when the low speed pull-up/pull-down driver is active.

In Example 36, the subject matter of Example 35 optionally includes means for providing a first one of the respective protective bias voltages to a p type pull-up transistor and means for providing a second one of the bias voltages to an n type pull-up transistor.

In Example 37, the subject matter of any one or more of Examples 33-36 optionally include wherein the high speed portion of the display interface driver comprises first and second pull-up transistors, the first pull-up transistor to drive data for a first subset of the two or more display interfaces, the second pull-up transistor to drive data for a second subset of the two or more display interfaces.

In Example 38, the subject matter of any one or more of Examples 33-37 optionally include wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

In Example 39, the subject matter of any one or more of Examples 33-38 optionally include wherein the display interface comprises a PHY channel coupled in front of the display interface driver, the PHY channel having a path comprising a parallel to serial converter to process data of one of the two or more display interfaces received at the PHY channel as parallel words.

In Example 40, the subject matter of Example 39 optionally includes wherein the PHY channel has a bypass path that causes data of another one of the two or more display interfaces to bypass the parallel to serial converter, the data of the another one of the two or more display interfaces received at the PHY channel as a serial stream.

In Example 41, the subject matter of any one or more of Examples 33-40 optionally include wherein the display interface driver and the two or more display interfaces are cointegrated using a common semiconductor integrated circuit die.

In Example 42, the subject matter of any one or more of Examples 33-41 optionally include wherein the display interface driver and the two or more display interfaces are cointegrated in a single integrated circuit package.

Method examples described herein may be machine or computer-implemented at least in part. Some examples may include a computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, in an example, the code may be tangibly stored on one or more volatile, non-transitory, or non-volatile tangible computer-readable media, such as during execution or at other times. Examples of these tangible computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

What is claimed is:

1. An integrated circuit, comprising:

a display controller having a driver, the display controller being configurable to select amongst two or more display interfaces, the driver designed to drive respective signals for each of the two or more display interfaces through a single output;

the driver comprising a high speed pull-up/pull-down driver and a low power pull-up/pull-down driver whose respective outputs are coupled to the output;

wherein the high speed pull-up/pull-down driver includes transistors whose gate dielectrics are thinner than transistors of the low power pull-up/pull-down driver; and wherein the transistors of the high speed pull-up/pull-down driver are coupled to protective switch circuits that provide respective protective bias voltages to prevent dielectric breakdown when the low speed pull-up/pull-down driver is active.

2. The integrated circuit of claim 1, wherein the display controller is configured to, when a first display interface of the two or more display interfaces is selected, disable other display interfaces of the two or more display interfaces.

3. The integrated circuit of claim 1, further comprising the protective switch circuits.

4. The integrated circuit of claim 1, wherein the display controller is configured to provide a first one of the respective protective bias voltages to a p type pull-up transistor and to provide a second one of the bias voltages to an n type pull-up transistor.

5. The integrated circuit of claim 1, wherein the high speed pull-up/pull-down driver comprises first and second pull-up transistors, the first pull-up transistor to drive data for a first subset of the two or more display interfaces, the second pull-up transistor to drive data for a second subset of the two or more display interfaces.

6. The integrated circuit of claim 1, wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

7. The integrated circuit of claim 1, wherein the display controller comprises a PHY channel coupled in front of the driver, the PHY channel having a path comprising a parallel to serial converter to process data of one of the two or more display interfaces received at the PHY channel as parallel words.

8. The integrated circuit of claim 7, wherein the PHY channel has a bypass path that causes data of another one of the two or more display interfaces to bypass the parallel to serial converter, the data of the another one of the two or more display interfaces received at the PHY channel as a serial stream.

9. The integrated circuit of claim 1, wherein the driver and the two or more display interfaces are cointegrated using a common semiconductor integrated circuit die.

10. The integrated circuit of claim 1, wherein the driver and the two or more display interfaces are cointegrated in a single integrated circuit package.

11. A method of selecting amongst multiple display interfaces, comprising:

selecting a display interface from two or more display interfaces, the selected display interface having a lower power than unselected display interfaces of the two or more display interfaces;

disabling transistors of a high speed portion of a display interface driver in response to the selecting, the disabling including providing bias voltages to gates of the transistors of the high speed portion to prevent gate dielectric breakdown of the transistors while a low power portion of the display interface driver is driving data signals of the selected display interface; and driving data signals of the selected display interface through an output, wherein voltages of the data signals also reach the transistors.

12. The method of claim 11, wherein the high speed portion of the display interface driver is a high speed pull-up/pull-down driver and includes transistors whose gate dielectrics are thinner than transistors of the low power portion of the display interface driver, which is a low power pull-up/pull-down driver.

13. The method of claim 11, wherein the transistors of the high speed portion of the display interface driver are coupled to protective switch circuits that provide respective protective bias voltages to prevent dielectric breakdown when the low speed pull-up/pull-down driver is active.

14. The method of claim 13, further comprising, providing a first one of the respective protective bias voltages to a p type pull-up transistor and providing a second one of the bias voltages to an n type pull-up transistor.

15. The method of claim 11, wherein the high speed portion of the display interface driver comprises first and second pull-up transistors, the first pull-up transistor to drive data for a first subset of the two or more display interfaces, the second pull-up transistor to drive data for a second subset of the two or more display interfaces.

16. The method of claim 11, wherein the two or more display interfaces include at least two of Display Port (DP), embedded Display Port (eDP), High Definition Multimedia Interface (HDMI), high speed Mobile Industry Processor Interface (MIPI) Display Serial Interface (DSI), and low power MIPI DSI.

17. The method of claim 11, wherein the display interface comprises a PHY channel coupled in front of the display interface driver, the PHY channel having a path comprising a parallel to serial converter to process data of one of the two or more display interfaces received at the PHY channel as parallel words.

18. The method of claim 17, wherein the PHY channel has a bypass path that causes data of another one of the two or more display interfaces to bypass the parallel to serial converter, the data of the another one of the two or more display interfaces received at the PHY channel as a serial stream.

19. The method of claim 11, wherein the display interface driver and the two or more display interfaces are cointegrated using a common semiconductor integrated circuit die.

20. The method of claim 11, wherein the display interface driver and the two or more display interfaces are cointegrated in a single integrated circuit package.

21. A computing system comprising:

a graphics controller; and a display controller coupled to the graphics controller, the display controller having a driver, the display controller being configurable to select amongst two or more display interfaces, the driver designed to drive respective signals for each of the two or more display interfaces through a single output;

the driver comprising a high speed pull-up/pull-down driver and a low power pull-up/pull-down driver whose respective outputs are coupled to the output;

wherein the high speed pull-up/pull-down driver includes transistors whose gate dielectrics are thinner than transistors of the low power pull-up/pull-down driver; and wherein the transistors of the high speed pull-up/pull-down driver are coupled to protective switch circuits that provide respective protective bias voltages to prevent dielectric breakdown when the low speed pull-up/pull-down driver is active.

22. The computing system of claim 21, wherein the display controller is configured to, when a first display interface of the two or more display interfaces is selected, disable other display interfaces of the two or more display interfaces.

23. The computing system of claim 21, further comprising the protective switch circuits.

24. The computing system of claim 23, wherein the display controller is configured to provide a first one of the respective protective bias voltages to a p type pull-up transistor and to provide a second one of the bias voltages to an n type pull-up transistor.

25. The computing system of claim 21, wherein the high speed pull-up/pull-down driver comprises first and second pull-up transistors, the first pull-up transistor to drive data for a first subset of the two or more display interfaces, the second pull-up transistor to drive data for a second subset of the two or more display interfaces.

* * * * *